US005664669A

United States Patent [19]

VanFleet

[11] Patent Number: 5,664,669

[45] Date of Patent: Sep. 9, 1997

[54] JEWELRY HANGER AND ORGANIZER

[76] Inventor: Dorothy VanFleet, 50 Berkely St. E181, Satellite Beach, Fla. 32937

[21] Appl. No.: 613,227

[22] Filed: Mar. 8, 1996

Related U.S. Application Data

[63] Continuation-in-part of Ser. No. 504,517, Jul. 20, 1995, abandoned, Provisional application No. 60/002,870 Aug. 28, 1995, Provisional application No. 60/003,198 Sep. 5, 1995, and Provisional application No. 60/003,428 Sep. 8, 1995.

[51] Int. Cl.[6] ..... A45C 11/04

[52] U.S. Cl. ..... 206/6.1; 206/459.5; 206/566; 211/113

[58] Field of Search ..... 206/6.1, 486, 566, 206/495, 459.5, 806; 211/13, 113; 248/317; 281/27.2, 30; 383/106

[56] References Cited

U.S. PATENT DOCUMENTS

| | | | |
|---|---|---|---|
| 2,753,914 | 7/1956 | Boyd | 383/106 |
| 3,206,014 | 9/1965 | Blumberg | 206/6.1 |
| 3,884,443 | 5/1975 | McMaster . | |
| 4,693,441 | 9/1987 | Conway . | |
| 4,811,973 | 3/1989 | Kumar-Misir | 281/27.2 |
| 4,890,809 | 1/1990 | Good . | |
| 4,968,540 | 11/1990 | Linsenbigler | 206/806 |
| 5,020,761 | 6/1991 | Good et al. . | |
| 5,240,120 | 8/1993 | McDonough | 206/495 |
| 5,423,505 | 6/1995 | David | 206/806 |
| 5,498,089 | 3/1996 | Motyka | 281/27.2 |

*Primary Examiner*—Paul T. Sewell
*Assistant Examiner*—Luan K. Bui
*Attorney, Agent, or Firm*—Frank A. Lukasik

[57] ABSTRACT

A compact jewelry organizer for connecting a pair of earrings and retaining earrings for pierced ears as well as clip earrings and cuff links together as pairs. The invention is generally a stiff plastic sheet cut in the shape of a dog bone. Mounting holes are located near each end for inserting the posts or clips of a pair of earrings and securing the earrings in place with clip on backings or a clip. Another embodiment contains a removable hang tag formed in the middle portion, between the mounting hole portions, for hanging the pair of earrings on a display rack. The hang tag is creased or punched with holes at the point where it connects to the dog bone to facilitate removal of the tag by bending. Other embodiments include multiple mounting holes, a hole for hanging the hang tag on a pegboard and a snap rivet for attaching the invention inside a purse.

15 Claims, 17 Drawing Sheets

JEWELRY HANGER AND ORGANIZER

RELATED APPLICATIONS

This application is a Continuation-In-Part of Ser. No. 08/504,517, Filed Jul. 20, 1995, now abandoned; Provisional application Ser. No. 60/002,870, Filed Aug. 28, 1995; Provisional application Ser. No. 60/003,198, Filed Sep. 5, 1995; and Provisional application Ser. No. 60/003,428, Filed Sep. 8, 1995, all of which are incorporated by reference.

BACKGROUND OF THE INVENTION

1. Field of the Invention

This invention relates generally to jewelry holders and more specifically to ornaments for the earlobe and also cuff links and means for holding the jewelry together in pairs and for hanging the ornaments on the display racks and hanger wires of retail store displays.

2. Description of the Prior Art

One of the problems to which the present invention is directed is the provision of a device for conveniently holding a pair of earrings together after purchase, usually in a jewelry box, having limited space. Heretofore, merchandising packages have been made suitable for hanging by the use of cards or the like, forming the body of the package, or stapled to the package and having a punched hanging hole. Most of the cards in current use are relatively large and as such are generally too large to keep many cards in a limited space such as a jewelry box.

Another problem to which the present invention is directed is to the provision of a hang tag for displaying and marketing earrings and cuff links. The prior art hang tags generally comprise a hanging region that is upstanding and formed with an opening to receive the hanger wire. One such hang tag is shown in U.S. Pat. No. 4,890,809 to Good which discloses a hang tag folded on itself, and its hanging region is adhered to its stick-on region so that it lies flat against a package during shipment. The adhesive between the hanging region and the stick-on region is arranged so that the hanging region can be unfolded after shipment to be upstanding from the object for hanging the object on a hanger wire.

U.S. Pat. No. 4,693,441 to Conway discloses a point of purchase flexible pad holder and display which includes a stiff plastic sheet having an upper clear section which may snap into a price channel, be hung on a peg, snapped onto a horizontal wire, locked into the top of the exposed corrugations of cut packing boxes, cases, or the like, and which may be used in total or in part to position and secure tear-off pads or displays to essentially any surface. U.S. Pat. No. 3,884,443 to McMaster, in FIG. 4, shows a hanger which is of a modified form having a slot instead of a mere aperture. This enables a customer to remove one package from the rear of others without first removing the others. This is especially useful when there is a choice of colors, for example.

U.S. Pat. No. 5,020,761 to Good et al discloses a hang tag which is cut and bendable to form an opening divided between a central region that receives a single wire hanger and end regions that receive a double wire hanger. Uncut tension zones between the central region and the end regions are breakable to receive double wire hangers, but remain unbroken to help support the weight of an object hanging on single wire hangers.

SUMMARY OF THE INVENTION

The invention provides all of the marketing and display features of the prior art and in addition provides a compact, effective, inexpensive, earring organizer for conveniently connecting a pair of earrings and retaining earrings for pierced ears as well as clip earrings together as pairs. The invention combines the features of a hang tag for displaying earrings or cuff links for marketing purposes and a compact, space saving, storage medium. The invention may also be conveniently used to display and keep cuff links and a matching tie tack together for sale and continuing use to keep pairs of cuff links together.

The invention is generally a stiff plastic sheet cut or molded in the shape of a dog bone. Mounting holes are located near each end for inserting the posts of a pair of earrings and securing the earrings in place with clip on backings. The rounded shape of the mounting ends is sized to provide sufficient surface area for gripping between the front of the earring or cuff link and the backing or clip on the back of the jewelry item. The length of the central portion of the invention and the diameters of the round end portions of the invention are determined by the size of the jewelry being mounted. The combination of the two round end portions separated by the central portion resembles the shape of a dog bone.

A second embodiment provides slots, extended across the mounting holes, or oval shaped holes, horizontal to the dog bone, to accommodate the insertion of clip-on earrings or cuff links. A third embodiment contains a detachable hang tag (display card) formed in the middle portion, between the round end, mounting hole portions, for hanging the pair of earrings or cuff links on a display rack. The hang tag is creased, scored or punched with holes at the point where it connects to the dog bone to facilitate removal of the tag by bending. The hang tag portion may have a single hanging hook to fit over a peg board display hanger, or it may have a wider hanging portion folded over at the top to form a hanging hook for mounting on display boards. An image of advertising or promotional material may be formed or printed on the face of the jewelry organizer for use as an advertising or promotional item. Alternate embodiments for the hang tag portion include various size mounting holes for use with rod type hangers and for attachment to day timers.

DETAILED DESCRIPTION OF THE INVENTION

Figure 2:
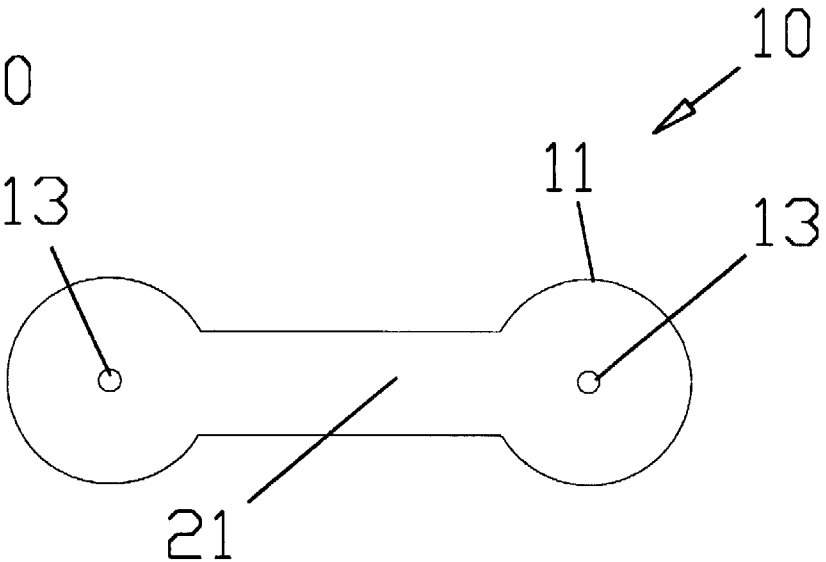
FIG. 2 is a front plan view of a preferred embodiment of the invention.
Figure 1:
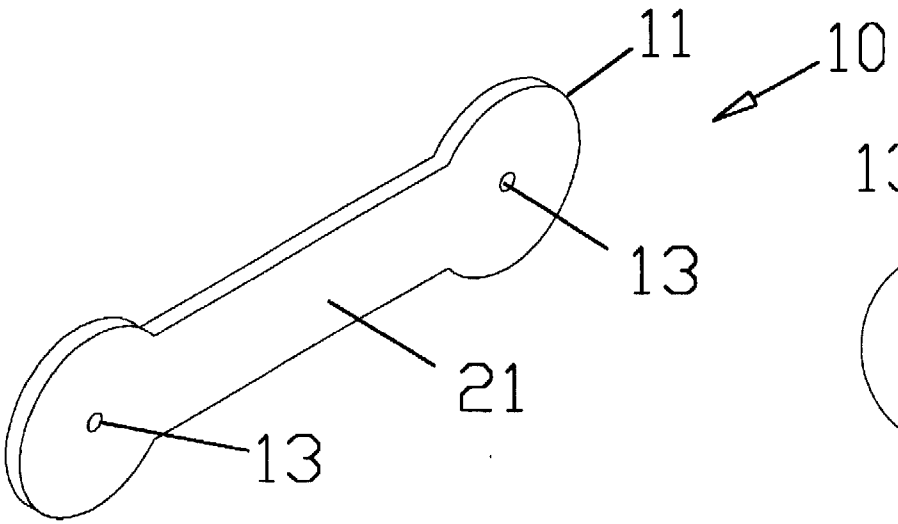
FIG. 1 is a top perspective view of a preferred embodiment of the jewelry organizer of the invention.
Figure 4:
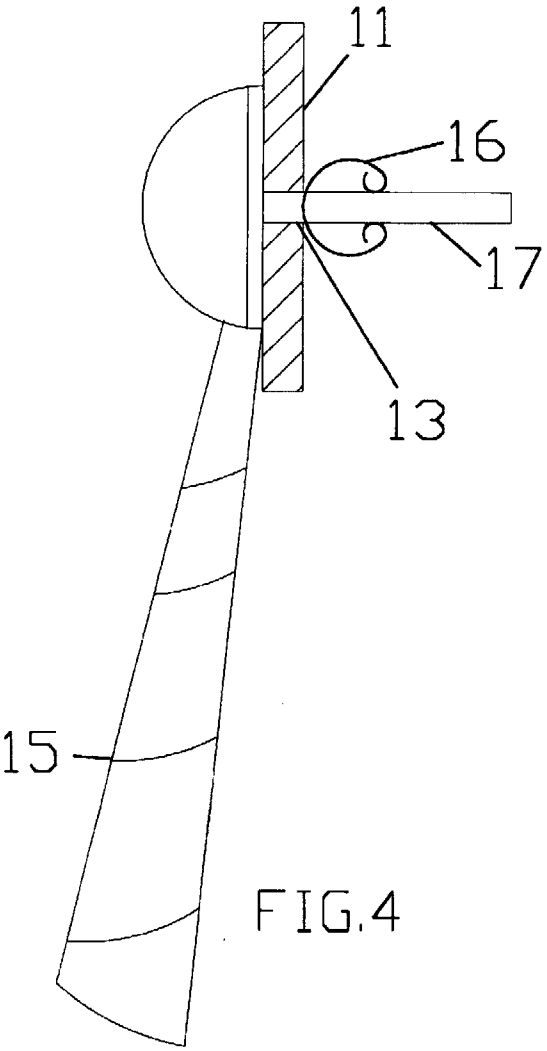
FIG. 4 is a side view, partially in section, of a pair of pierced ear earrings mounted on the invention.
Figure 3:
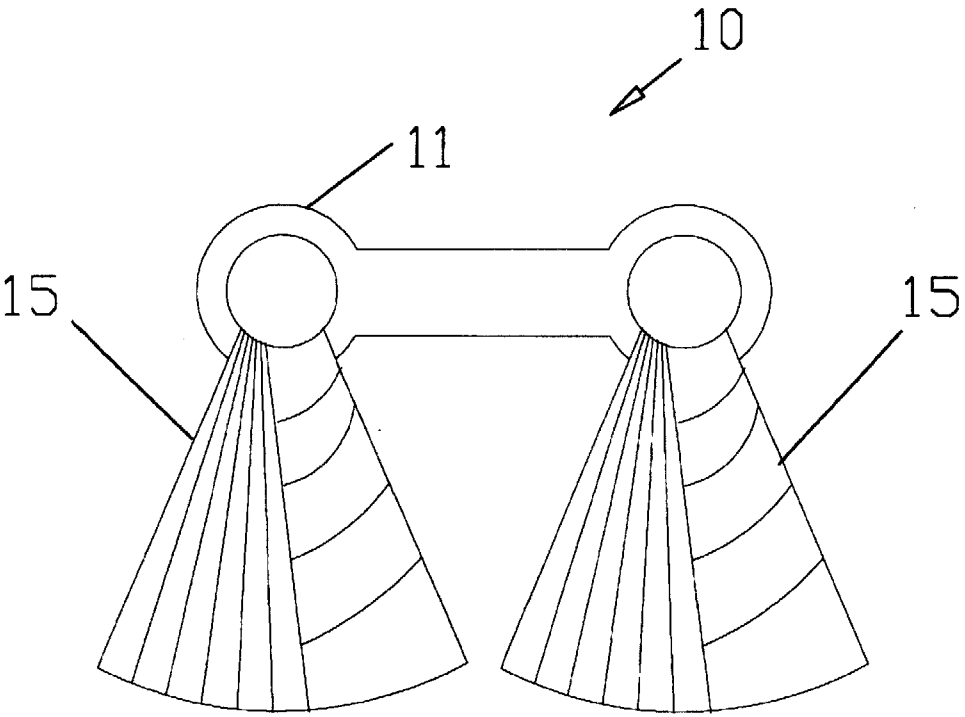
FIG. 3 is a front plan view of a pair of pierced ear earrings mounted on the invention.
Figure 6:
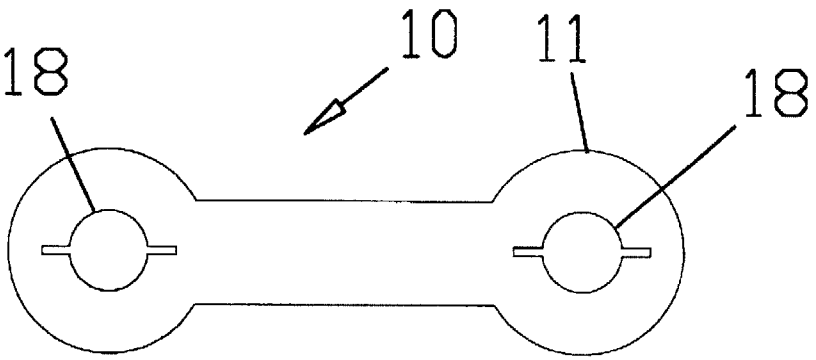
FIG. 6 is a front plan view of the jewelry organizer for mounting clip-on earrings.
Figure 5:
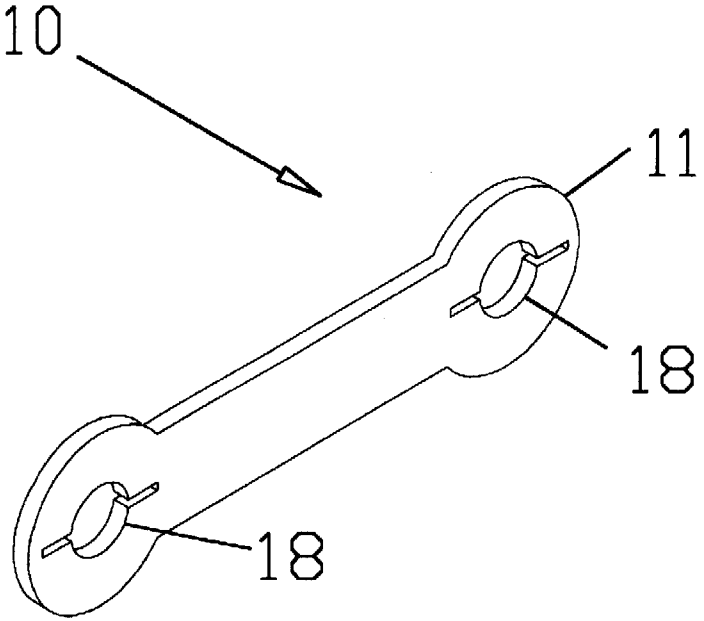
FIG. 5 is a top perspective view of the jewelry organizer for mounting clip-on earrings.

Referring to FIGS. 1 through 4, it will be seen that the jewelry organizer 10 of the present invention comprises a generally dog bone shaped, flexible, plastic material. The plastic material may be polyester resin, mylar or any equivalent plastic material. While the material may be fairly rigid, it is nontheless flexible. The jewelry organizer 10 may also be die cut from a thinner plastic. When a thinner material is used, a velvet or velveteen material (not shown) may be laminated thereto to provide a non-skid surface. The laminated material may also be velour, flock, or any cloth material.

The jewelry organizer 10 includes round end portions 11 and central portion 21. Holes 13 are formed in the centers of round end portions 11 for inserting the posts 17 of earrings 15. The earrings 15 are then held in place by backs 16.

In a preferred embodiment, jewelry organizer 10 was made from 1/32" thick plastic material. Because of the variety of sizes of earrings 15, the sizes of the jewelry organizers may vary from small to extra large. As an example of the sizes, the width of the space between the mounting holes 13 may vary from 0.750 inches to 1.75 inches. The diameters of round end portions 11 may vary from 0.375 inches to 0.750 inches. The holes 13 may be a uniform diameter and in a preferred embodiment the diameter of hole 13 was 0.0625 inches. The diameters of round end portions 11 and the width of central portion 21 are determined by the diameters of the earrings to be mounted. The width of central portion 21 was in the range of 0.250 inches to 0.3660 inches for the range of sizes. The selected sizes provide sufficient gripping surface areas for the backs or clips, while effectively reducing the material used to manufacture the invention. The reduction of material results in a material savings for conservation of materials, and reduces the amount of space used in a jewelry box for storing the jewelry.

Figure 8:
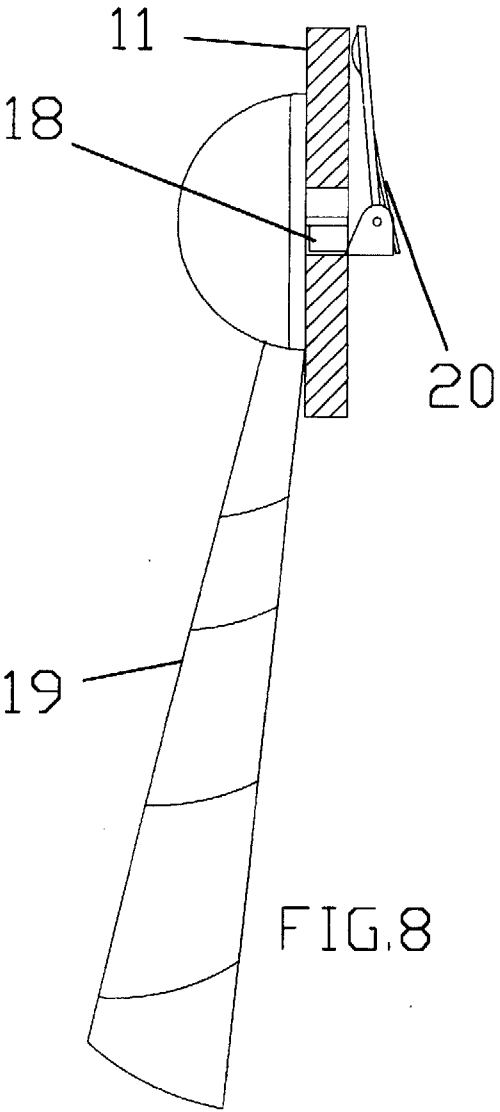
FIG. 8 is a side view, partially in section, of a pair of clip-on earrings mounted on the jewelry organizer.
Figure 7:
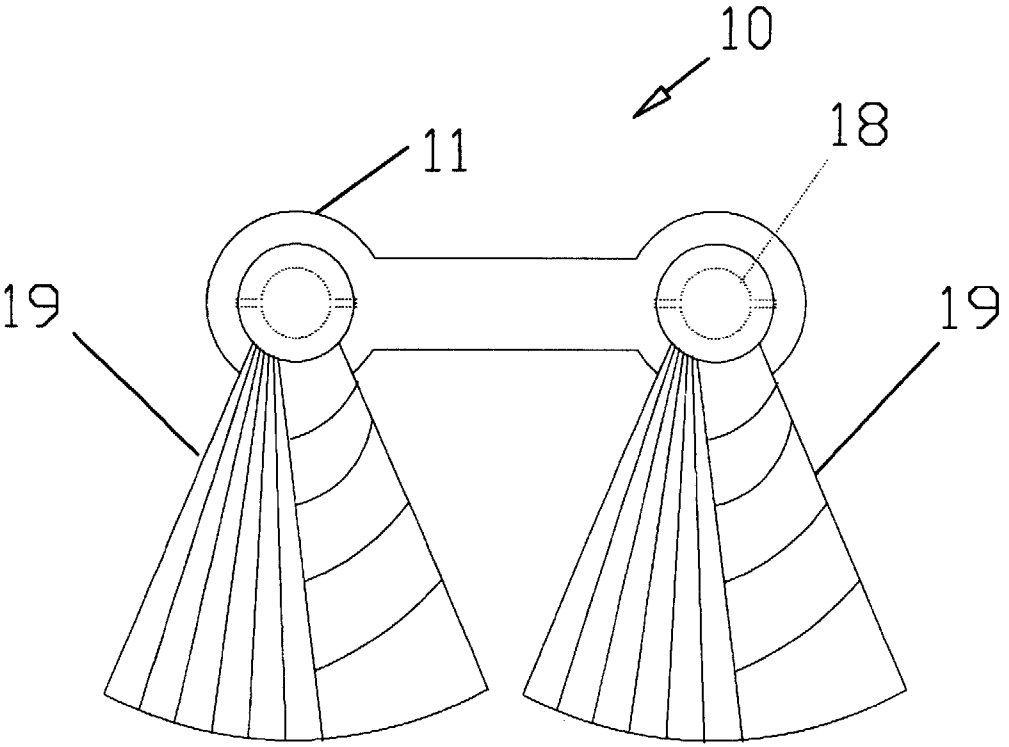
FIG. 7 is a front plan view of a pair of clip-on earrings mounted on the jewelry organizer.
Figure 10:
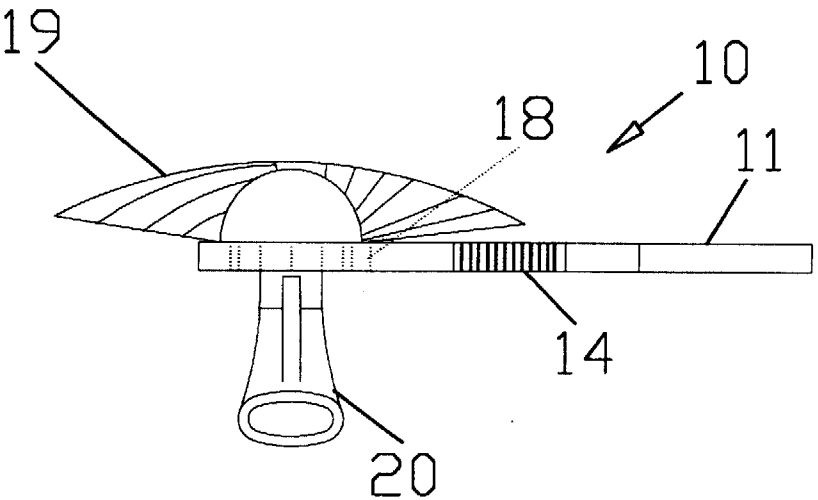
FIG. 10 is a top view showing the clip inserted into the hole and slot of the jewelry organizer.
Figure 9:
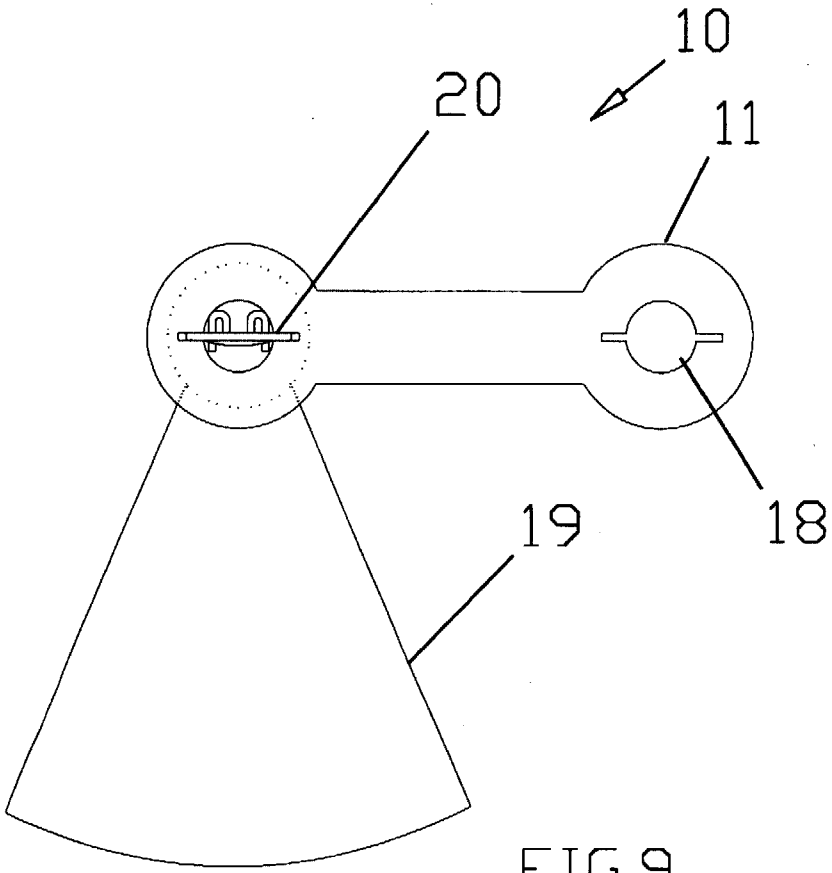
FIG. 9 is a rear plan view showing the mounting clip inserted into the hole and slot of the jewelry organizer.
Figure 35:
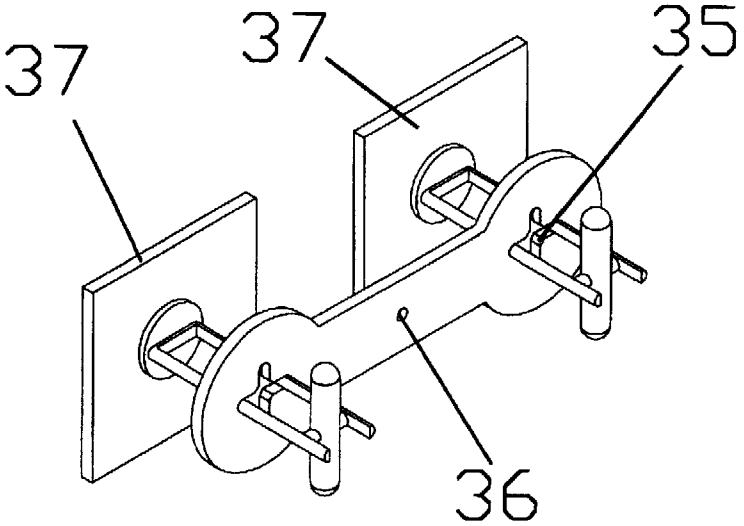
FIG. 35 is a top perspective view of the modified invention showing a pair of mounted cuff links and for mounting a tie tack.
Figure 33:
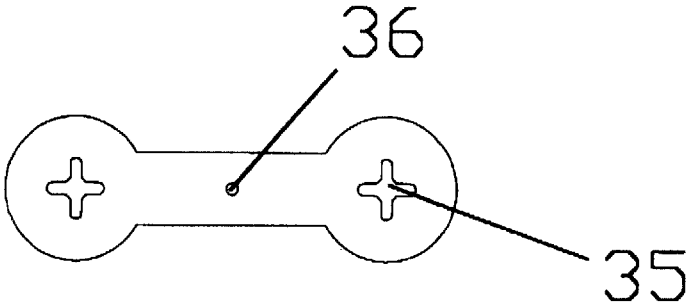
FIG. 33 is a front plan view of the invention modified for keeping cuff links together and for mounting a tie tack.
Figure 34:
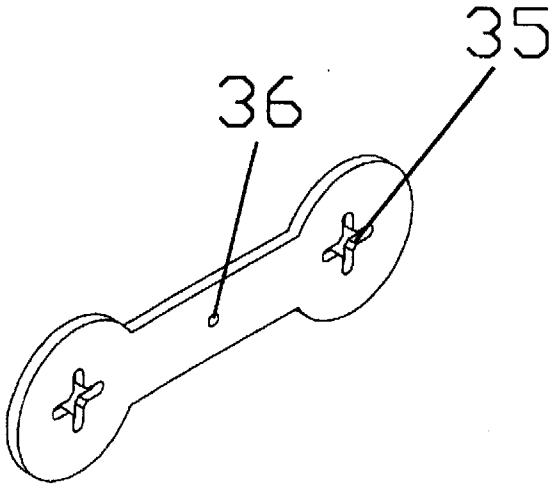
FIG. 34 is a top perspective view of the invention modified for keeping cuff links together and for mounting a tie tack.

Referring now to FIGS. 5 through 10, there is shown a second embodiment of the jewelry organizer 10 of the invention adapted for mounting clip-on earrings. FIGS. 33–35 show the invention modified for holding cuff links. Slotted holes 18 and 35 are formed in the centers of round end portions 11 to accommodate the back clips 20 as they are inserted into slotted holes 18 or 35. FIG. 8 shows the clip 20 in a down position and gripping the jewelry organizer 10 in a locking position. FIGS. 9 and 10 show the clip 20 in a horizontal position as it is inserted through the slotted hole 18 and before it is locked in the down position.

Figure 12:
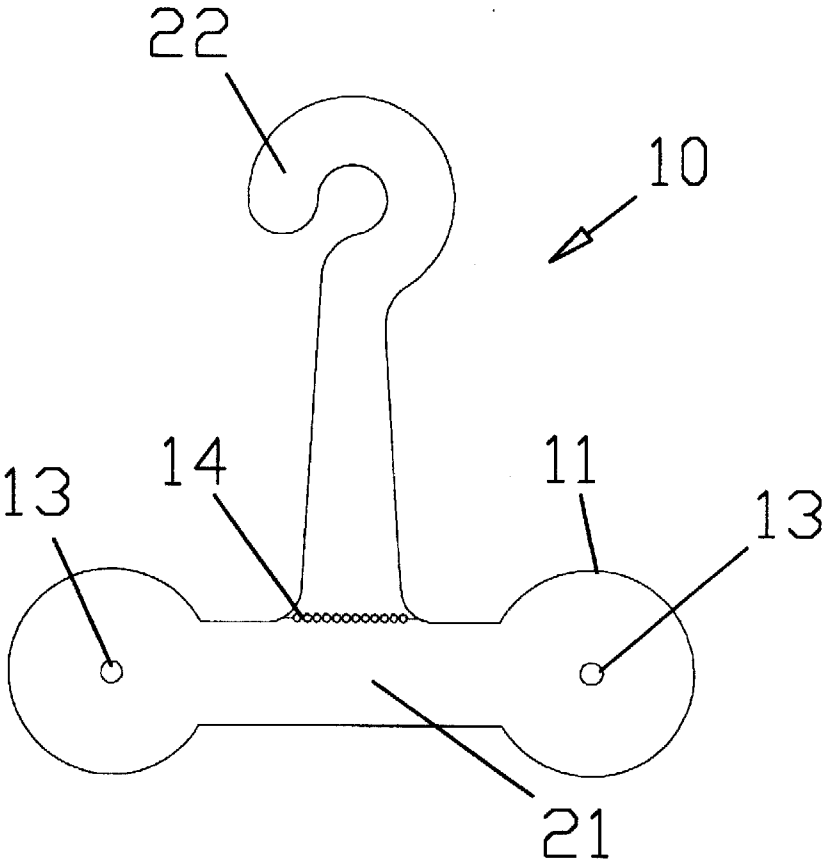
FIG. 12 is a front view of a second embodiment of the invention used as a hang tag.
Figure 11:
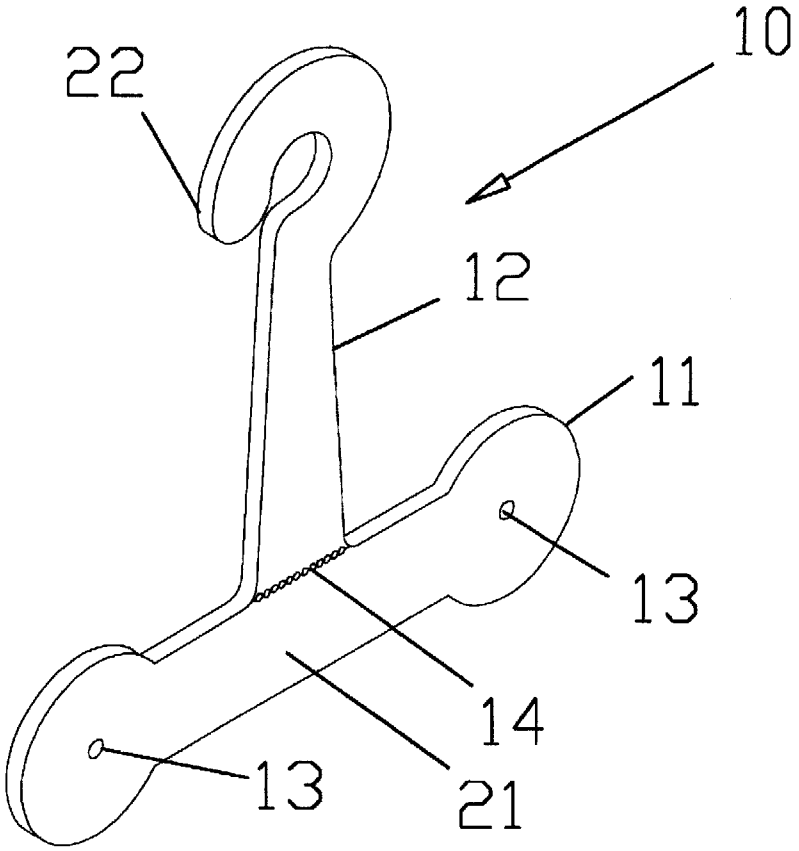
FIG. 11 is a top perspective view of a second embodiment of the invention used as a hang tag.

FIGS. 11 through 32 show another embodiment of the jewelry organizer 10, that is, as a hang tag (display card) for hanging and displaying a pair of earrings or cuff links. Adding hanger hook 12 to the middle portion 21 converts the jewelry organizer 10 to a hang tag. FIG. 11 is a top perspective view of the jewelry organizer 10 with hanger hook 12 formed during manufacture of the dog bone shaped jewelry organizer 10. A score line 14 is formed between the central portion 21 and hanger hook 12 by either creasing a score line or by punching a row of small holes shown as score line 14. FIG. 12 is a front view of the jewelry organizer 10 showing the hanger hook 12. In a specific example of the invention, the length of the hanger hook 12 was 1½" from the central portion 21 to the top of the hooked portion 22. The length of the hanger hook 12 may be the same for all sizes and embodiments of the jewelry organizer 10 since the product will be suspended at the same level.

Figure 14:
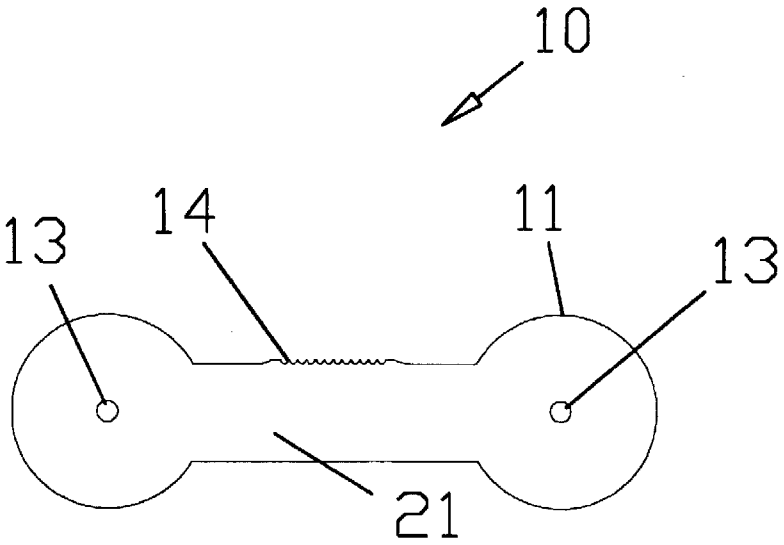
FIG. 14 is a front view of a second embodiment of the invention showing the hanger hook totally removed.
Figure 13:
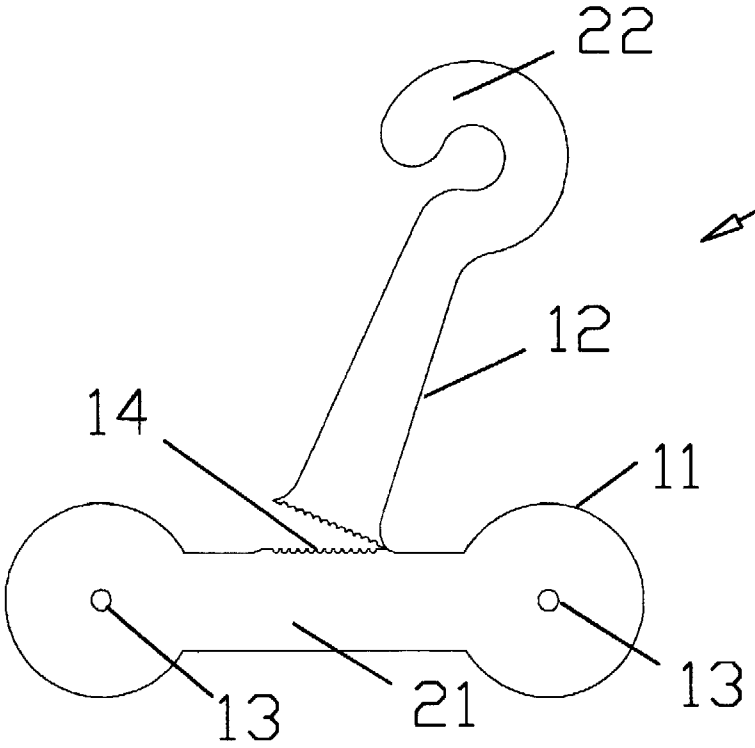
FIG. 13 is a front view of a second embodiment of the invention showing the hanger hook partially removed.
Figure 16:
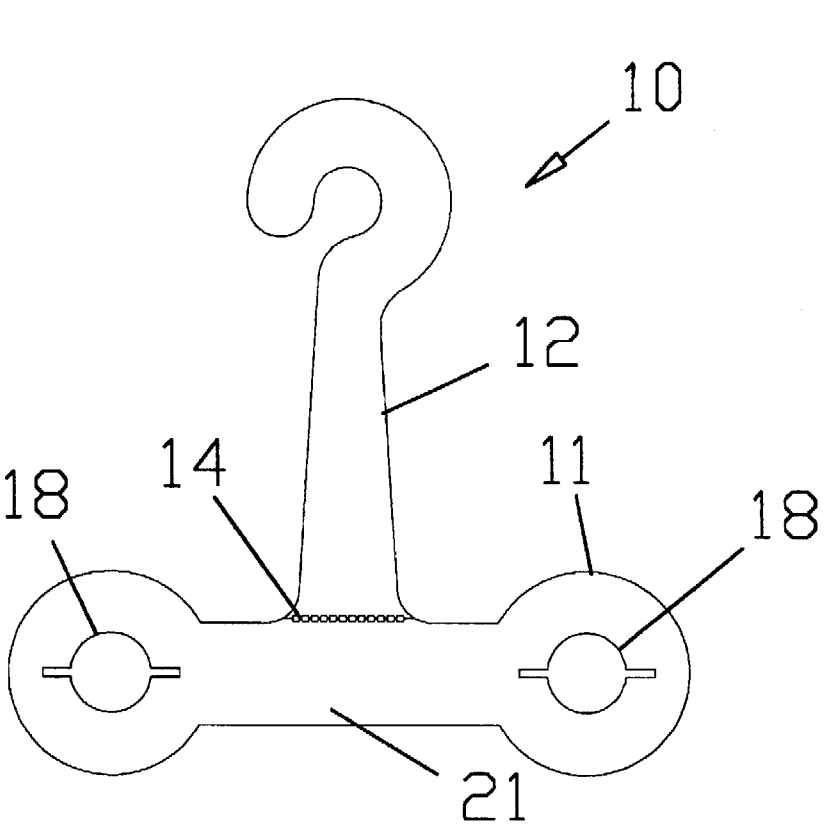
FIG. 16 is a front view of a second embodiment of the invention adapted for clip-on earrings.
Figure 15:
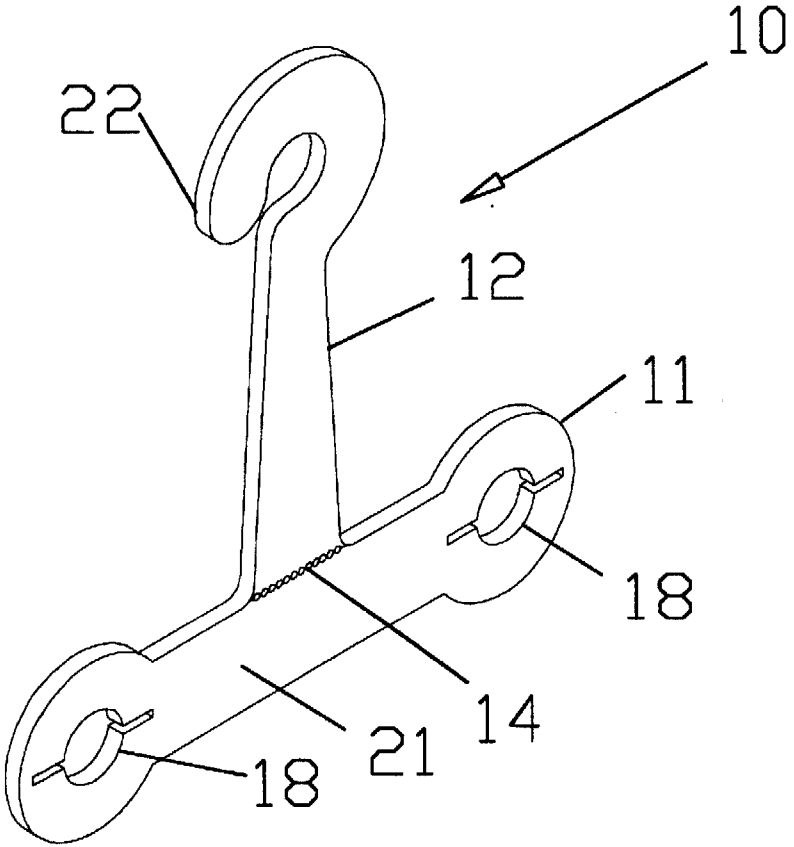
FIG. 15 is a top perspective view of a second embodiment of the invention adapted for clip-on earrings.
Figure 18:
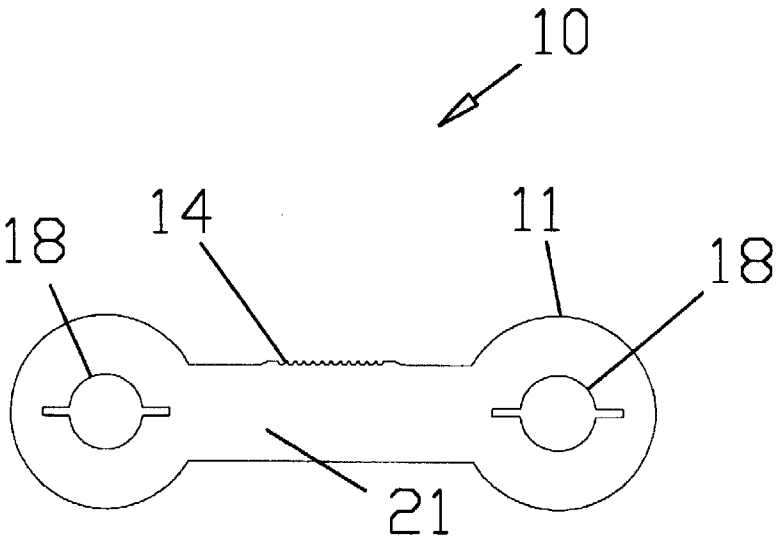
FIG. 18 is a front view of a second embodiment of the invention showing the hanger hook totally removed.
Figure 17:
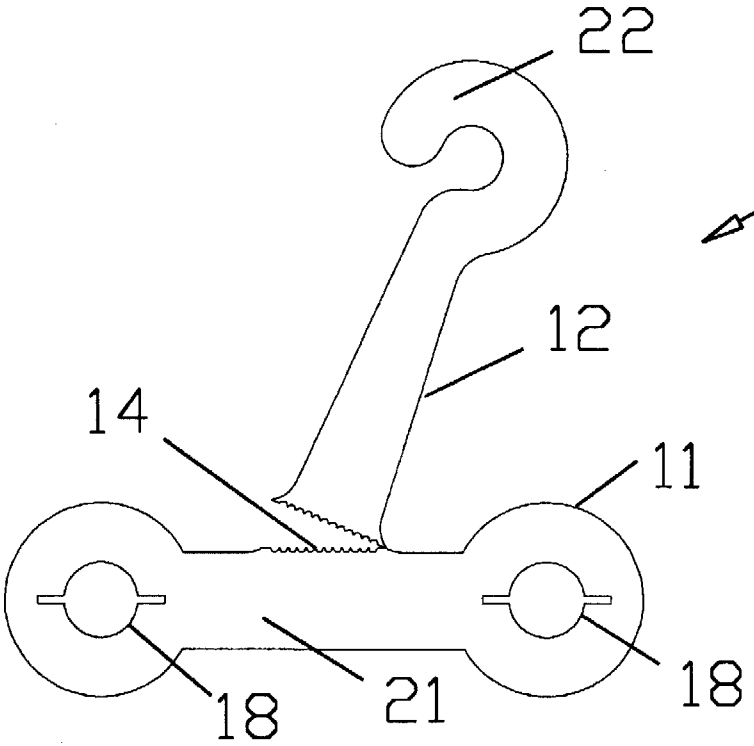
FIG. 17 is a front view of a second embodiment of the invention showing the hanger hook partially removed.
Figure 20:
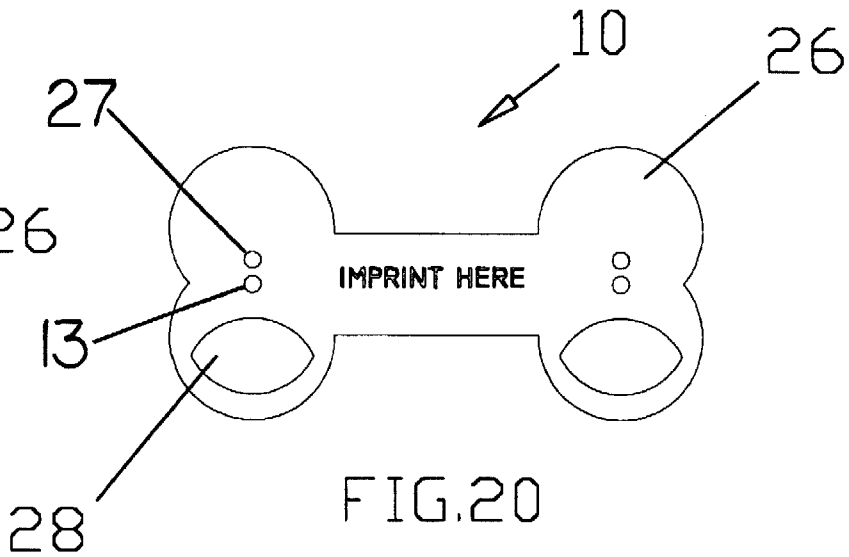
FIG. 20 is a front view of a third embodiment of the invention showing inverted, alternate mounting options.
Figure 19:
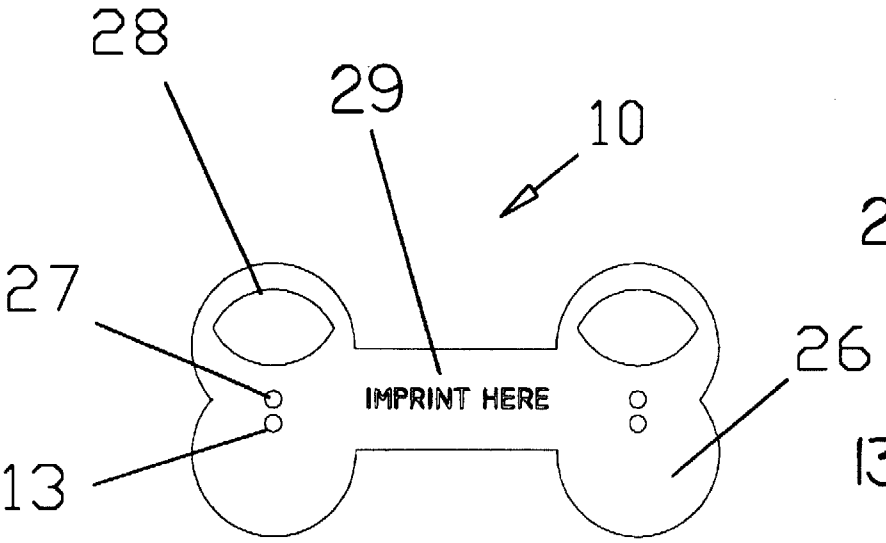
FIG. 19 is a front plan view of a third embodiment of the invention showing alternate mounting options.
Figure 22:
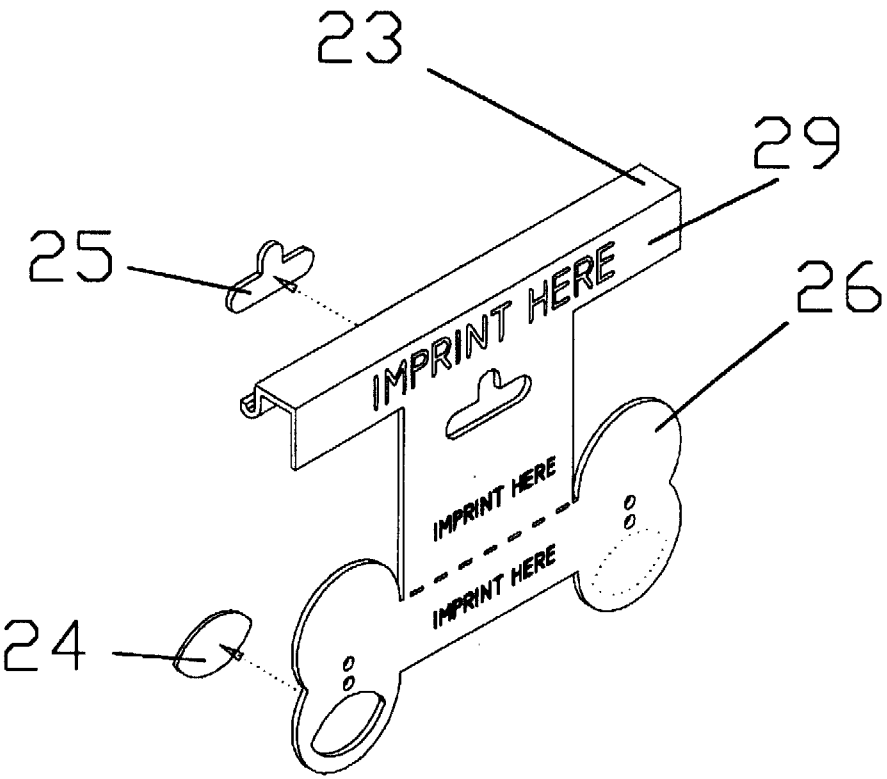
FIG. 22 is a top perspective view of a third embodiment of the invention used as a hang tag.
Figure 21:
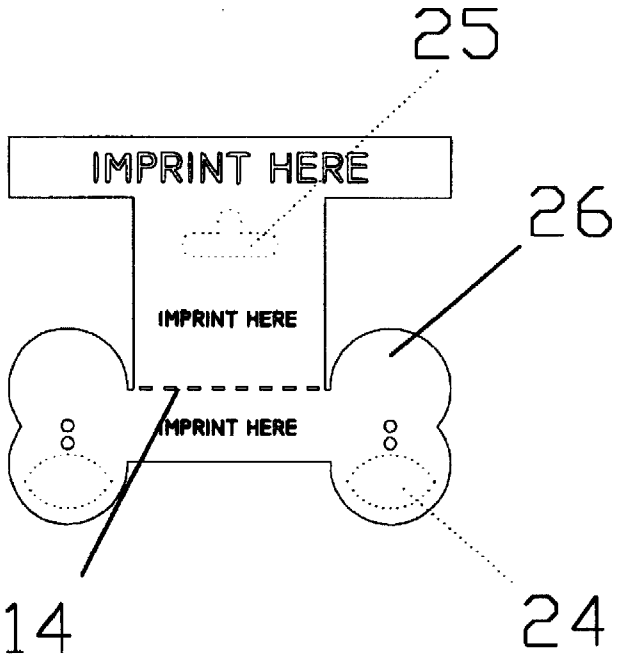
FIG. 21 is a front plan view of a third embodiment of the invention used as a hang tag.
Figure 24:
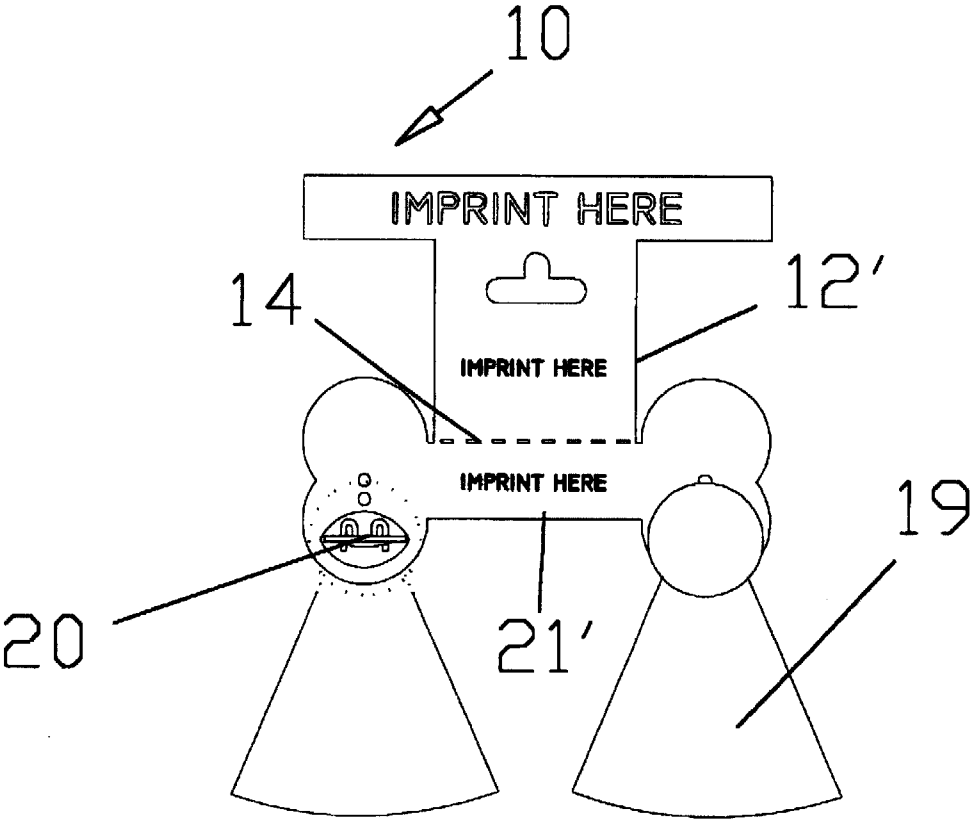
FIG. 24 is a front plan view of a pair of clip-on earrings mounted on a third embodiment of the invention.
Figure 23:
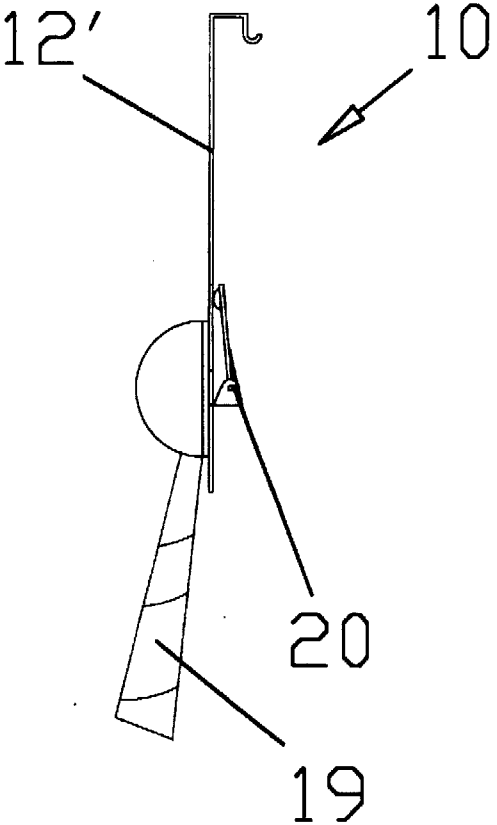
FIG. 23 is a side view of a pair of clip-on earrings mounted on a third embodiment of the invention.
Figure 26:
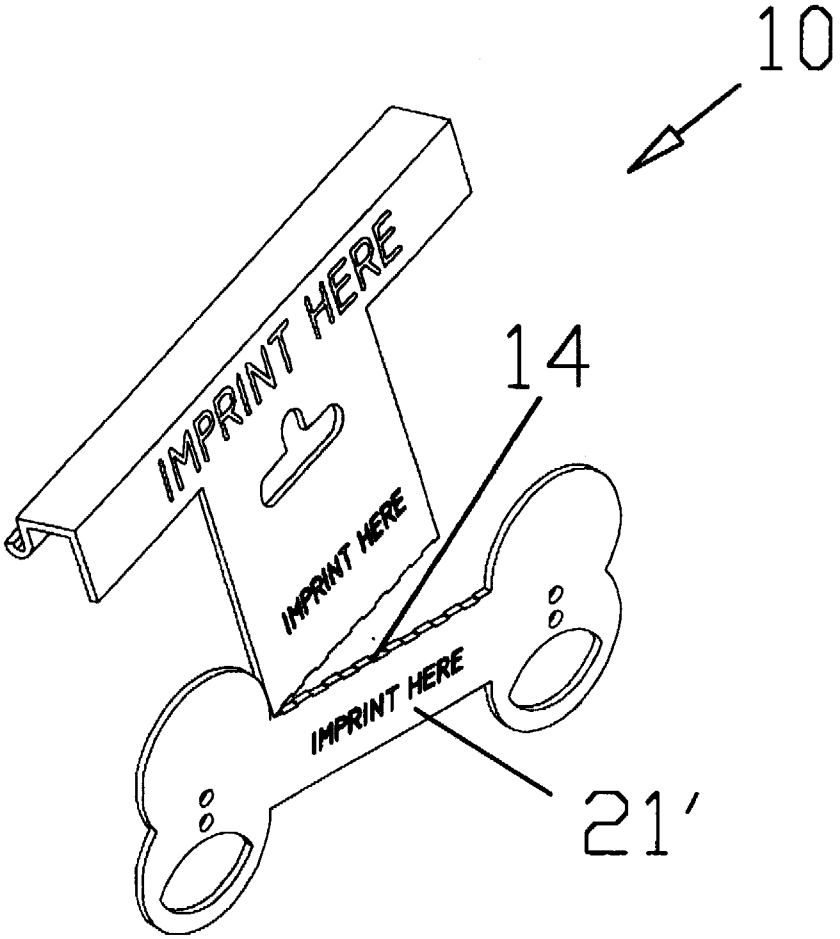
FIG. 26 is a top perspective view of the hang tag being removed from the jewelry organizer of the invention.
Figure 25:
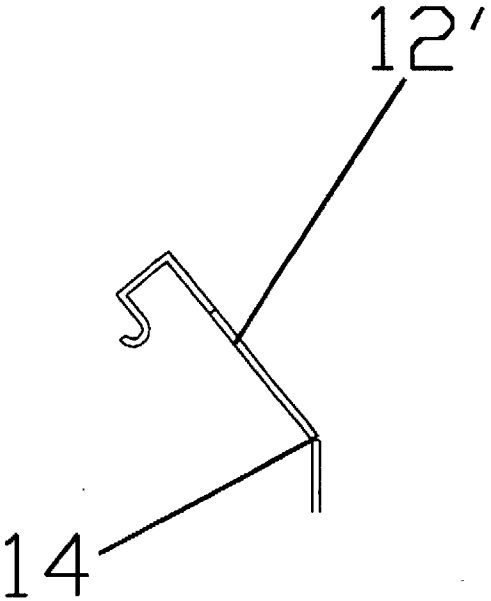
FIG. 25 is a side view of the hang tag being removed from the jewelry organizer of the invention.
Figure 28:
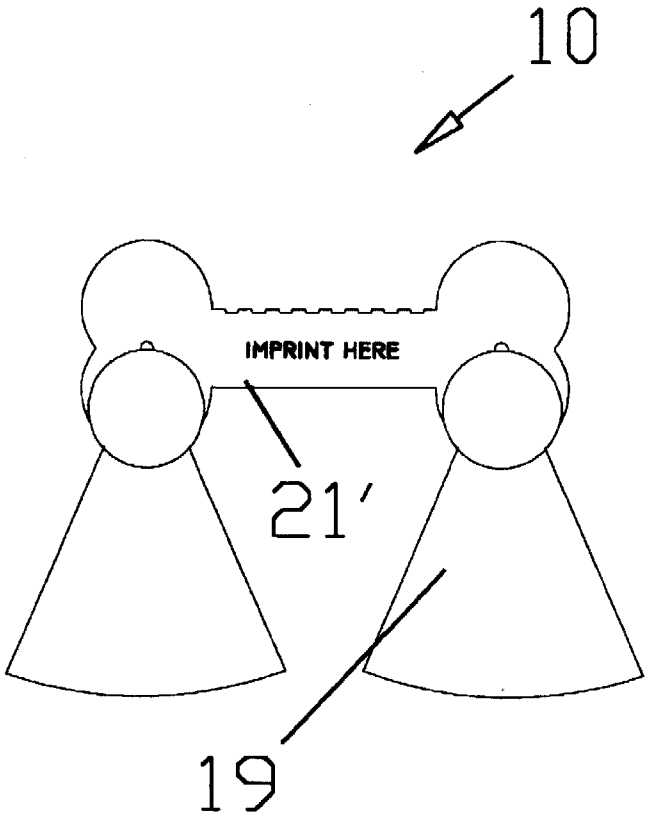
FIG. 28 is a front plan view of a separated jewelry organizer with a pair of clip-on earrings attached.
Figure 27:
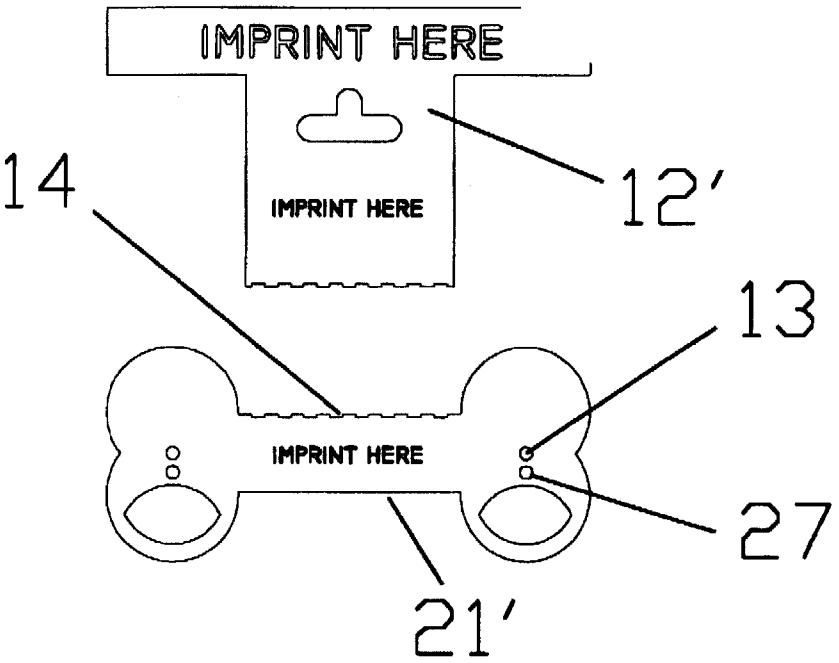
FIG. 27 is a front plan view of the hang tag and the jewelry organizer, separated.

FIG. 13 is a front view of a second embodiment of the invention showing the hanger hook 12 partially removed. FIG. 14 is a front view of the second embodiment showing the hanger hook 12 totally removed and the rough surface left by tearing along the score line 14 and removing hanger hook 12. The remaining shape of the jewelry organizer 10 is similar to the first embodiment, that is, for earrings having posts 17 for pierced ears.

FIGS. 15 through 18 are views of a hanger hook 12 formed as part of the second embodiment, that is, the jewelry organizer 10 adapted to hold clip-on earrings 19. The figures depict the various stages of removal of the hanger hook 12 as described above for the jewelry organizer 10 for earrings having posts 17 for pierced ears.

The preferred embodiment of the jewelry organizer 10 of the invention, without the hanger hook 12, may be included with each pair of earrings sold by pinning the jewelry organizer 10 to the display hanger of a hang tag currently being used by the manufacturer. The purchaser may then discard the hang tag to save space in a jewelry box or other earring storage unit. The jewelry organizer 10 may contain sufficient information, logo, or address and the currently used hang tag may be eliminated. As a better alternative, the manufacturer may use the hanger hook 12 embodiment of the invention as a hang tag and let the buyer remove the hook for storing the combined pair of earrings.

FIGS. 19 through 28 show a third embodiment of the invention with the jewelry organizer 10 having two sets of holes 13 and 27 for earring posts and a pair of holes 28 for clip-on earrings. In addition, hanger 12' and middle portion 21' are wider and contain punch out areas 24, and 25 and a hanging hook 23. Hanging hook 23 consists of an inverted "U" shaped horizontal channel connected to middle portion 21' containing punch out areas 24 and 25. The Punch out areas 24 and 25 may be only partially stamped and left in place until a user intends to hang the hang tag on a peg board post. The punch out areas 24 and 25 need only be pushed out to form the hanging area.

There is sufficient space on the dog bone shaped jewelry organizer 10, as well as the hanger hook 12' version to print logos or advertising materials or any type of printed material 29. The jewelry organizers 10 shown in FIGS. 19 and 20 contain holes 28 in different positions, that is, the clip-on earring holes are formed in the top half in FIG. 19 and the bottom half in FIG. 20. The alternative sizes, locations, and shapes for the holes, provide flexibility of use for various shapes and sizes of earrings 19.

Figure 29:
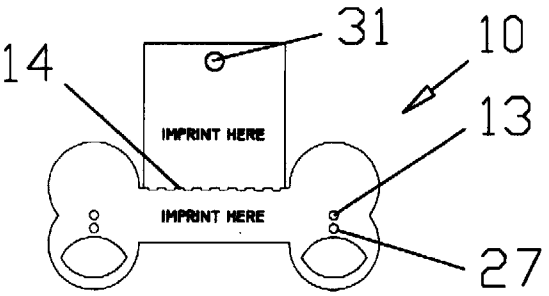
FIG. 29 is a front plan view of a hang tag for a special application.
Figure 30:
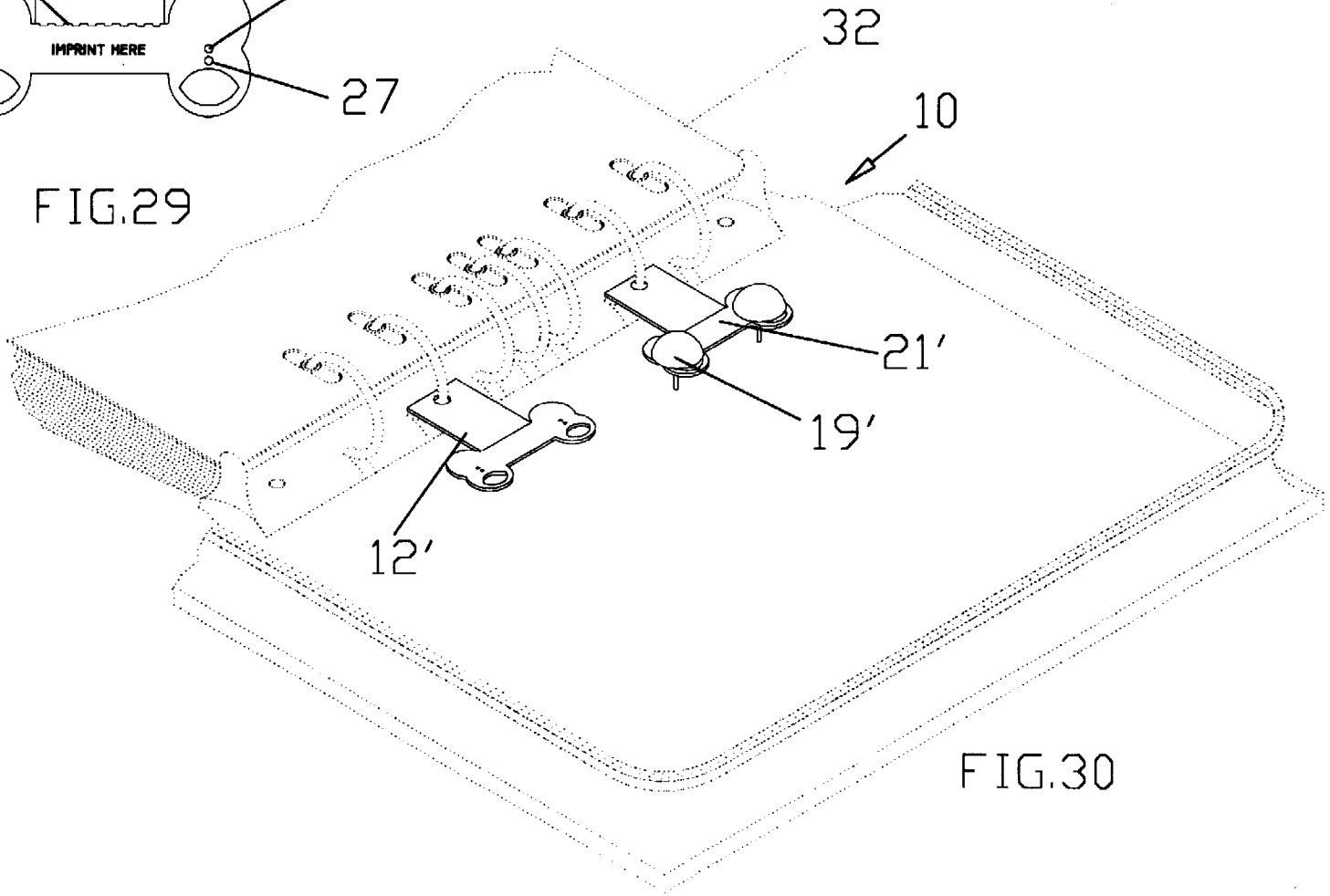
FIG. 30 is a top perspective view of the invention mounted in a planning binder.
Figure 32:
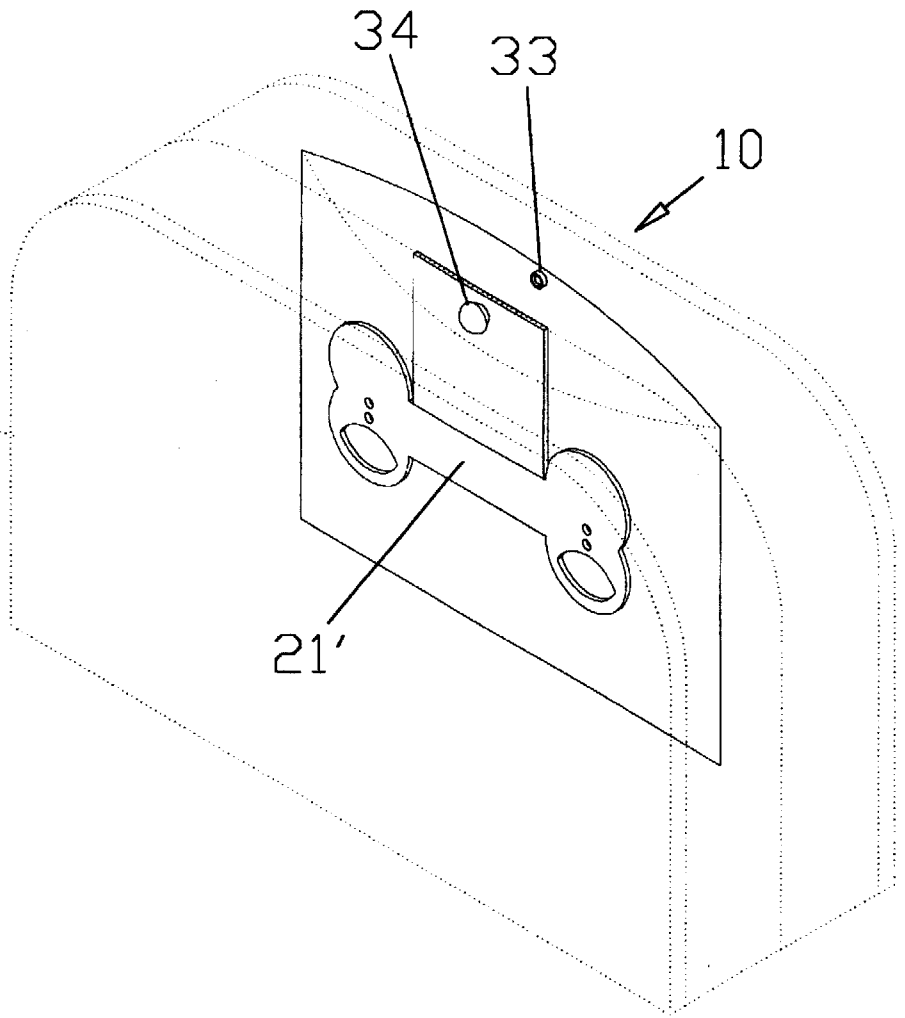
FIG. 32 is a top perspective view of a snap rivet fastening the invention inside a purse.
Figure 31:
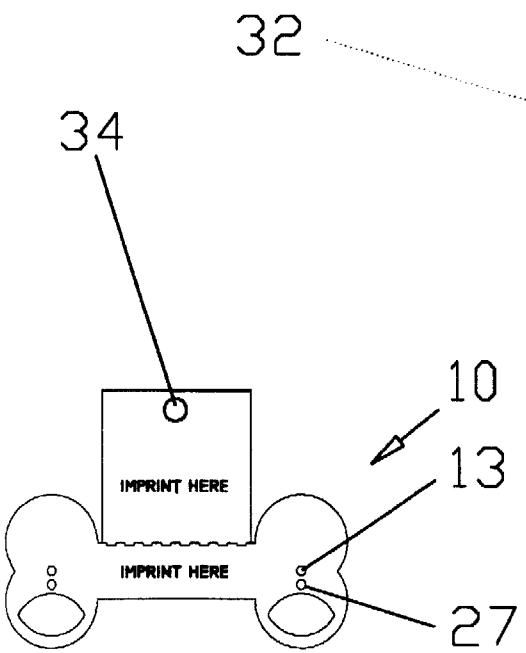
FIG. 31 is a front view of a hang tag having a snap rivet for mounting.

The central portion 21' has sufficient area to imprint a logo or other information. A hole 36 may be punched in central portion 21' to mount a tie tack or four holes 36 may be formed to mount tuxedo shirt studs. FIGS. 29 and 30 show a hole 31 formed at the top of hanger 12' for mounting in a day timer in the form of a loose leaf binder. FIGS. 31 and 32 show a snap rivet 34 inserted in the hole 31 to mount the jewelry organizer 10 on the inside of a woman's purse.

FIGS. 33–35 show the slotted hole 35 which is designed to accept the posts of a pair of cuff links. A hole 36 is also formed to provide a convenient mounting hole for a matching tie tack, thereby keeping all three pieces of a set together. An additional use of the jewelry organizer 10 would be feasible if four holes 36 were formed to hold a set of formal shirt studs (not shown).

It will be appreciated that a wide variety of hang tags are employed in point of purchase retailing to which the earring organizer of the invention may readily be secured in the fashion indicated or replaced by the earring organizer 10 of the invention.

In any event, it will be appreciated that applicant's present invention greatly improves the versatility and application of the prior art while improving the use and reducing the cost of such prior art.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A pair of earrings and a compact jewelry organizer for mounting a pair of earrings and retaining a pair of post earrings for pierced ears, as well as clip earrings, together, in pairs, said jewelry organizer consisting of:

a flexible plastic sheet, said plastic sheet having two round end portions, said round end portions having their diameters adapted to accept and retain said earrings and a straight central portion connecting said round end portions, said straight central portion having the width adapted to accept and retain said earrings, and, each of said round end portions having at least one earring mounting hole formed therein, each of said earring mounting holes being adapted to accept one of a pair of earrings, said mounting holes being spaced by the length of said straight central portion at a distance required by the size of the earrings to be mounted.

2. The jewelry organizer of claim 1 wherein each of said mounting holes is formed to mount a post earring for pierced ears.

3. The jewelry organizer of claim 1 wherein each of said mounting holes is formed with a horizontal slot for mounting clip-on earrings.

4. The jewelry organizer of claim 1 wherein each of said round end portions are formed with a combination of pairs of holes for post earrings and holes for clip-on earrings.

5. The jewelry organizer of claim 1 wherein each of said mounting holes is formed with a horizontal and a vertical slot for mounting a pair of cuff links and said central portion formed with at least one mounting hole for mounting studs or tie tacks.

6. The jewelry organizer of claim 1 wherein the width of the space between said mounting holes is in the range between 0.750 inches to 1.75 inches.

7. The jewelry organizer of claim 1 wherein a hang tag is detachably formed on said straight central portion for adapting said jewelry organizer for hanging said earrings for point of sale display, said hang tag being detachable at a score line between said hang tag and said central portion.

8. The jewelry organizer of claim 7 wherein said hang tag is formed with a hanging hook.

9. The jewelry organizer of claim 8 wherein said hang tag contains a partially stamp cut, removable, punch out area forming a hanging hole area.

10. The jewelry organizer of claim 8 wherein said hang tag is formed with a hanging hole.

11. The jewelry organizer of claim 10 wherein said hanging hole contains a snap rivet.

12. A pair of earrings and a compact jewelry organizer for mounting a pair of earrings and retaining a pair of post earrings for pierced ears, as well as clip earrings, together, in pairs, said jewelry organizer consisting of:

a flexible plastic sheet, said plastic sheet having two round end portions, said round end portions having their diameters adapted to receive and retain said earrings, and a straight central portion connecting said round end portions, each of said round end portions having a plurality of mounting holes formed therein, each of said mounting holes being adapted to accept one of a pair of earrings, a first pair of said mounting holes each being formed to mount a post earring for pierced ears and a second pair of said mounting holes formed with a horizontal slot for mounting clip-on earrings, said mounting holes being spaced by the length of said straight central portion and the width of the space between said mounting holes is in the range between 0.750 inches to 1.75 inches.

13. The jewelry organizer of claim 12 wherein a hang tag having hanging means is detachably formed on said straight central portion for hanging said earrings for point of sale display, said hang tag being detachable, at a score line, from said central portion.

14. The jewelry organizer of claim 13 wherein said hang tag contains pre-punched, removable blanks for a mounting hole and mounting holes for clip-on earrings.

15. A pair of earrings and a compact jewelry organizer for mounting a pair of earrings and retaining a pair of post earrings for pierced ears, as well as clip-on earrings and cuff links, together, in pairs, said jewelry organizer comprising:

a flexible plastic sheet, said plastic sheet having two round end portions, said round end portions having their diameters adapted to accept and retain said jewelry, and a straight central portion connecting said round end portions, said straight central portion having a width adapted to accept and retain said jewelry, each of said round end portions having a plurality of mounting holes formed therein, each of said mounting holes adapted to accept one of a pair of said jewelry, said mounting holes being spaced by the length of said straight central portion at a distance required by the size of the jewelry to be mounted, and a hang tag having a hook end and a detachable end, said hang tag formed on said straight central portion, between said round end portions, for hanging said jewelry for point of sale display, said hang tag having a score line formed where said detachable end attaches said hang tag to said central portion for removing said hang tag after purchase.

* * * * *